United States Patent [19]

Nosseir

[11] 4,416,768

[45] Nov. 22, 1983

[54] ORE BENEFICIATION

[75] Inventor: Sami S. Nosseir, Port Cartier, Canada

[73] Assignee: Quebec Cartier Mining Company, Montreal, Canada

[21] Appl. No.: 365,063

[22] Filed: Apr. 2, 1982

[51] Int. Cl.[3] ..... B03B 5/52

[52] U.S. Cl. ..... 209/3; 209/44; 209/459; 241/24

[58] Field of Search ..... 209/12, 13, 3, 10, 44, 209/459; 241/24

[56] References Cited

U.S. PATENT DOCUMENTS

| | | | |
|---|---|---|---|
| 2,075,466 | 3/1937 | Queneau | 75/1 |
| 2,428,228 | 9/1947 | Keck | 209/13 X |
| 2,487,845 | 11/1949 | Bird | 209/44 X |
| 2,962,231 | 11/1960 | Weston | 241/80 |
| 3,291,398 | 12/1966 | Weston et al. | 241/24 |
| 3,502,271 | 3/1970 | Hays | 241/20 |
| 3,715,083 | 2/1973 | Funk | 241/24 |
| 4,070,274 | 1/1978 | Bryson | 209/10 |
| 4,206,878 | 6/1980 | Forciea | 241/20 |

OTHER PUBLICATIONS

Thompson et al., "The Humphreys Spiral", Engineering and Mining Journal, Aug. 1950, pp. 87–89.

*Primary Examiner*—Ralph J. Hill
*Attorney, Agent, or Firm*—William L. Krayer

[57] ABSTRACT

Ground ore is processed in a series of three spiral concentrators wherein the initial spiral is operated to reject a tailing of a predetermined low value, the second spiral is operated to maximize the removal of locked middlings, and the third spiral is operated to obtain a concentrate of a predetermined value.

11 Claims, 1 Drawing Figure

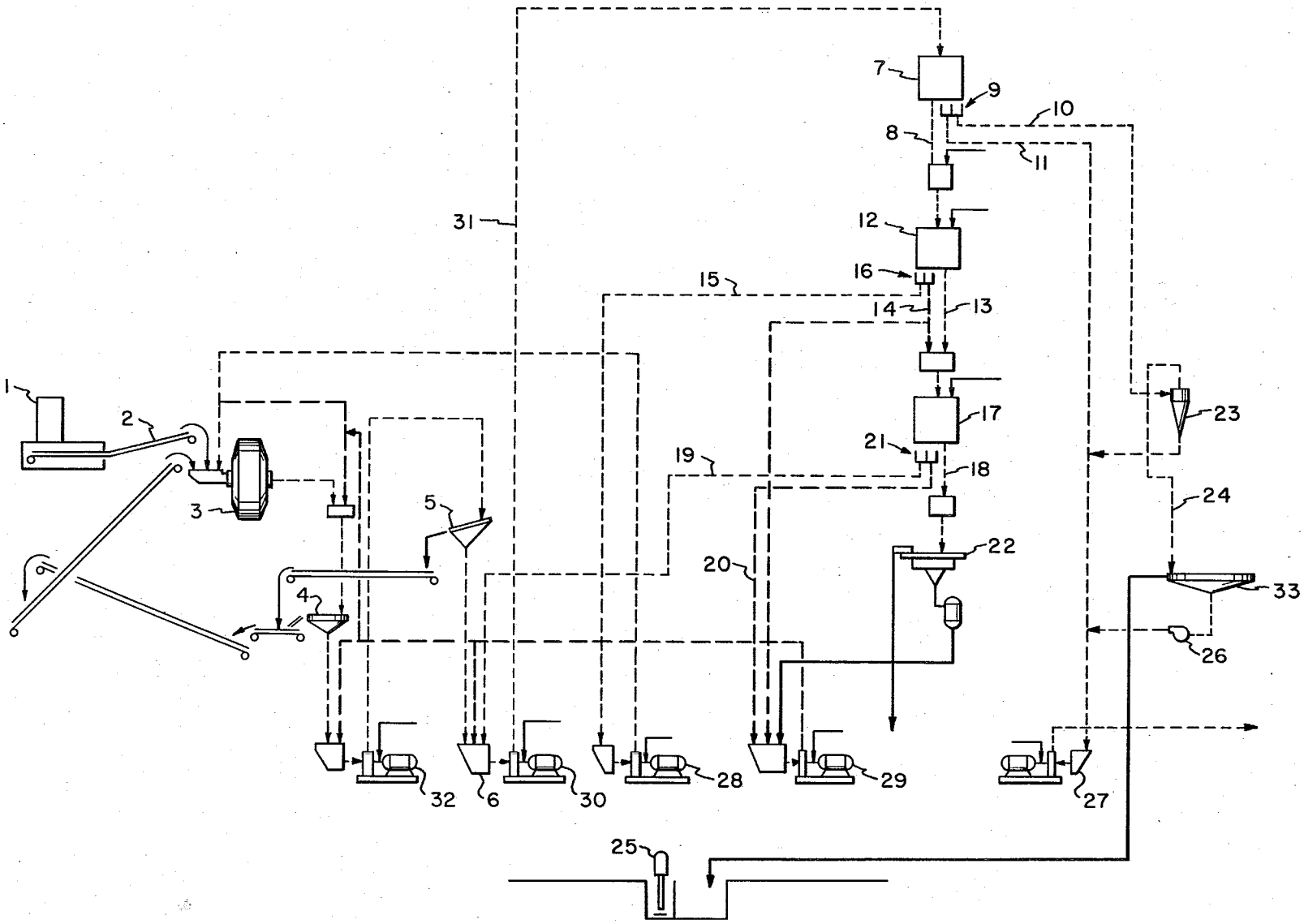
1
2
3
4
5
6
7
8
9
10
11
12
13
14
15
16
17
18
19
20
21
22
23
24
25
26
27
28
29
30
31
32
33

ORE BENEFICIATION

BACKGROUND OF THE INVENTION

The concentration of ore such as iron ore into a product which can be economically shipped and processed is a difficult endeavor and has historically taken many forms and variations. Ideally, an efficient process will require the least possible capital, use the least possible energy, employ the least possible water, and generate minimal waste disposal problems. Energy is consumed in grinding and pumping, and capital requirements entail significant expenditures for grinders, screens, gravity or other separators, and waste treatment facilities. Large quantities of water are used in almost all parts of a beneficiation plant, and waste disposal problems are functions of both water usage and the composition and quantity of tailings generated.

The primary objective of an ore beneficiation plant is to increase the value content of the product from its natural state to a practical high value depending on the kind of ore and the physical location of the next processing or utilization plant. In the case of iron ore, specular hematite in particular as found at Mt. Wright, Quebec, an ore containing about 31.4% iron is upgraded to a concentrate of about 66.3% iron. Many different flow sheets have been proposed and used for various ores, but generally it has been extremely difficult to increase recovery efficiency beyond a certain point without economic sacrifice.

In a commonly used process, ore ground to a sepcified size is separated in spiral separators designed and adjusted to employ the statistical separation efects of gravity flow in water. Large quantities of water must be handled, and in the past have contributed to a disposal problem and frequently necessitated the undesirable loss of iron, along with the water, in the form of fine particles. The processing of large quantities of recycled water has necessitated the use of organic polymeric flocculants, which have in the past found their way back into the system to form nutrients for bacteria. The bacterial deposits can alter the flow patterns in the spiral separators.

Another common problem is the loss of particles known as locked middlings, i.e. particles containing significant quantities of iron (or other mineral value) because of the inability of the spiral separator to distinguish between portions of the gangue and the locked middlings. It has been though that locked middlings could not be reground in an autogenous mill; however, as will be explained below, the locked middlings not only can be reground, but significant improvements in efficiency are obtained by doing so. The typical process step for locked middlings prior to the present invention was to treat the locked middlings as similar to misplaced middlings, and recycle them to the beginning of the spiral series. In processes aiming for a product of high purity, such as, in the case of specular hematite, of over 66% iron, no locked middlings can be tolerated in the product; consequently, they have in the past been eventually discarded and the value in them lost.

SUMMARY OF THE INVENTION

My invention is an ore beneficiation technique wherein (a) the ore is ground to a size which may be significantly larger than the otherwise optimum liberation size, and which incidentally represents a lower degree of liberation of the ore, (b) an initial separation of the ore is performed in a spiral separator, into a significantly low-iron tailing which is discarded and a concentrate which contains locked middlings, (c) a second separation is performed on the concentrate therefrom in a cleaner spiral to obtain a cleaner concentrate and a tailing, and (d) the sand fraction of the tailing from the cleaner spiral, which contains a significant amount of locked middlings, is recycled to the grinding step.

As is known in the art, the "optimum liberation size" for ore particles represents an economic balance of the mineral values to be obtained and the expense of separating them. The optimum liberation size varies with the physical and chemicl attributes of the ore and its value as liberated. My invention is particularly applicable where grinding economies can be realized by grinding to a size wherein about 10% to about 25% of the (metal) values remain locked in particles including significant amounts of gangue material. Specifically, the optimum size for liberation of iron from the specular hematite at Mt. Wright has been about 1.5 mm. As may be seen below, my invention permits the use of a grind of 3 mm, generally considered to be the maximum size for efficient use of spiral separators on specular hematitie.

My invention is especially applicable to particulate ore having a Taggart Concentration Criteria ("TCC") factor of between about 2.0 and about 3.0. As is known in the art, the TCC factor represents the ratio:

$$\frac{\text{Sp. gr. of heavy material} - \text{fluid density}}{\text{Sp. gr. of light material} - \text{fluid density}}$$

Generally, the "heavy" material will be the valuable material to be recovered, and, of course, higher TCC factors are correlated with efficiency of gravity separation techniques.

My invention permits the tolerance or use of an optimum liberation size larger than would otherwise be the case or, in other words, an ore having a relatively low degree of liberation. In addition, I have greatly optimized the use of recirculating water, resulting in reduced use of waste treatment chemicals and alleviating pollution control problems generally.

I will discuss the invention with particular reference to the processing of specular hematite.

Referring now to FIG. 1, crushed ore silo (1) containing crushed specular hematite preferably −9 inch in size feeds crushed ore by feed conveyor (2) to the intake of autogenous mill (3) for grinding. Exit from the mill is controlled by mill screens typically 6 or 8 mm in opening; the ground material is placed on a scalping screen (4) where the oversize ore is recycled to the mill (3). The undersize material from scalping screen (4) is passed to a sizing screen (5) which is sized at 3 mm. The undersize material from the sizing screen (5) is passed to a collecting pump (6) to be pumped and distributed into the tops of rougher spirals (7). The rougher spirals (7) are adjusted to separate the material into a concentrate (8) and a significantly low-iron tailing, i.e. no greater than about 8% iron, which is split in a two-way discharge box (9) into a water fraction (10) and a sand fraction (11).

The concentrate (8) from the rougher spiral (7) is fed with dilution water to the intake of cleaner spirits (12) for separation into a cleaner concentrate (13), a water fraction (14) and a sand fraction (15) comprising predominantly locked middlings, the sand fraction (15) and the water fraction (14) being separated in a splitter box (16). Wash water is injected in the cleaner spiral as is known in the art to enhance the horizontal displacement of particles, in this case mainly locked middlings. Part of the water fraction (14) is used for dilution of the cleaner concentrate (13) prior to introduction to a recleaner spiral (17), which separates it into a recleaner concentrate (18), a sand fraction (19) and a water fraction (20), the sand fraction and the water fraction being separated in a splitter box (21). The recleaner concentrate (18) is then filtered in filter (22) and otherwise prepared as a final product.

The water fraction (10) from the rougher spiral (7) is directed to a cyclone (23) for dewatering. The overflow (24) water from the cyclone is directed to thickener (33) wherein the solids may be flocculated and settled out. The overflow from the thickener (33) is reused as process water in a sump pump (25), and the solids are sent to a disposal pump (26) for disposal.

The sand fraction (11) from the rougher spiral is passed directly to the tailing pump (27) for disposal together with the underflow from cyclone (23).

An important feature of my invention is the use of sand fraction (15) from cleaner spiral (12). This fraction is sent directly back to the mill (3) for regrinding by pump (28). This sand fraction comprises predominantly locked middlings, i.e. particles which are partly iron and partly silica or other gangue material, which I have determined should not be recycled to the intake of the rougher spiral (7) or anywhere else in the circuit, because if they are so recycled without regrinding they will eventually be discarded in the tailings and the iron values in them will be lost. It should be noted that, in combination with the relatively large screen size of 3 mm at the sizing screen (5), the recycling of the sand fraction of the cleaner tailings results in a higher iron recovery rate than would be attainable otherwise.

The part of the water fraction (14) of the cleaner spiral which is not used for dilution of the cleaner concentrate is sent to a recycle pump (29) for use as part of a water source throughout the system. The sand fraction (19) from the recleaner spiral (17) is recycled by way of pump (30) to the intake of the rougher spiral (7). I have found that the middlings in sand fraction (19) are predominantly misplaced liberated concentrate with portions of liberated tailing and locked middlings. Such middlings are sometimes called mechanical middlings. Since these particles are almost entirely statistically mis-presented, and are in suitable physical condition for finding the correct outlet, they are re-directed to the inlet of the spiral system by way of line (31) along with the new material from screen (5). The tailings will ultimately be discarded through lines (10) or (11), the locked middlings will be reground after exiting through line (15), and the concentrate will find its way to filter (22).

The water fraction (20) from the recleaner spiral (17) is directed to recycle pump (29) for distribution together with filtrate water from filter (22) and a portion of water fraction (14) from cleaner spiral (12), to other parts of the system requiring dilution water, such as the mill intake, mill discharge, the spiral feed pump (30) and sizing screen feed pump (32).

It may be seen from the above description that only relatively small quantities of water need be discarded and that the relatively small quantities of water used in the thickener may result in reduced flocculent usage. Moreover, the initial grinding and screening set point can be larger than would otherwise be practical for optimum selectivity. This permits improvements in the grinding rate and energy consumption.

The spiral concentrators useful in my invention may be any of the well-known commercially available spiral concentrators such as those discussed in U.S. Pat. Nos. 3,235,081; 3,235,079; 3,099,621; 3,753,491; 3,235,080; 3,568,832 and 2,700,469. In particular, the disclosures in Humphreys U.S. Pat. No. 2,431,559 and Persson U.S. Pat. No. 3,568,832, which illustrate common methods of controlling wash water, are incorporated by reference herein in their entirety. Spiral concentrators commonly in use comprise a trough from about 8 to about 15 inches wide, spiraling downward about 13 inches to 18 inches in a 360° turn, and curving upwards towards the outside edges of the helix substantially as illustrated in the aforesaid Humphreys patent.

While the separation of material in a spiral concentrator is influenced by a number of fractors in addition to specific gravity, such as the concentration of solids, various mesh sizes, the shapes of the particles, the curvature and pitch of the spiral, the velocity, quantity, and viscosity of the water, and so forth, the basic idea of the separator is that particles with relatively high specific gravities will be captured in the drains located on the inside curvature of the spiral and the relatively light particles will remain in the main stream. The distribution of the particles can be strongly influenced, however, as is known in the art by using the wash water injection points to exert more or less lateral displacement of the stream and the particles in it, the result of more lateral displacement being that fewer particles report to the concentrate; under less lateral displacement, as I use in the rougher spiral, more particles report to the concentrate, leaving, in the case of specular hematite, small but more value-free tailing to be discarded from the rougher.

It is a particular advantage of my invention that water usage is greatly reduced as a direct result of the recycling of the locked middlings. Because I recycle the locked middlings to the mill from the cleaner spirals, the fluid drag forces in the rougher spiral 7 need not be amplified by large quantities of wash water directed laterally in the helical trough to overcome the tendency of the locked middlings to report by gravity to the concentrate. The problem created by this tendency is compounded where the middlings are allowed to build up by recycling them only to the spiral feed without regrinding. Large quantities of wash water have been used in the past to overcome this difficulty and maintain the iron content of the concentrate from the rougher spiral at the desired level resulting, however, in an additional loss of iron to the tailings as well as increased water consumption.

It has been conventional in the prior art to employ a "step upgrading" strategy for iron recovery, in which the spiral concentrators in series merely produce product of gradually increasing iron content. For example, at my own plant, the rougher spiral has been operated at times to produce a concentrate of about 58% iron, which is fed to the cleaner spiral to produce a concentrate of about 62% iron, which is fed to the recleaner spiral to produce a concentrate of about 66% iron. My invention, however, provides an essentially new approach wherein the objective in the operation of the rougher spiral is to dispose of a clean (low-iron) tailing, the objective in the operation of the cleaner spiral is to separate locked middlings, and the objective in the operation of the recleaner spiral is to recover a product of the desired iron content. I refer to this strategy as a "staged differential function" strategy for the use of spiral concentrators in series.

The objective in the rougher stage is accomplished by employing a minimal quantity of wash water, i.e. by minimizing the horizontal displacement of particles so that particles having specific gravities in the range between those of high-iron and low-iron particles will report with the high-iron particles to the concentrate. The objective in the cleaner stage is met by increasing the quantity of wash water injected to increase the horizontal displacement, thereby permitting a smaller portion of medium-range specific gravity particles to pass through with the concentrate. The rest of the material from the cleaner spiral therefore contains a significant portion of locked middlings.

A demonstration of my invention was made in a manner designed to illustrate separately the effects of the large initial screen opening (mesh of grind) and the recycling of the locked middlings. No modification was made to recycle water directly from the cleaner spiral or the recleaner spiral during this demonstration.

Referring to Table I, ore was fed to the system substantially as described above under the following notable conditions. Throughout the test periods, mill A was kept in the "unmodified" mode, i.e. the usual 2 mm screen was used to control the grind size and there was no recycle of middlings. In the first and third periods, the only difference used in mill B was a 3 mm screen; in the second and fourth periods the 3 mm screen was retained and, in addition, the middlings were recycled as shown in FIG. 1.

During the first and third periods, line B exhibited a slight improvement in recovery at the fine end of the size range but on the coarse end large losses were observed. The results in the second and fourth periods demonstrate that recycling converts the results particularly in the coarse end to a significant recovery advantage, as will be appreciated by persons skilled in the art.

TABLE I

| MILL LINE A - 2 mm Screen | | | | | | MILL LINE B | MILL LINE B - 3 mm Screen | | | | | |
|---|---|---|---|---|---|---|---|---|---|---|---|---|
| TONS | GRADES | | | RECOVERY | | OPERATING | | GRADES | | | RECOVERY | |
| CRUDE | FEED | CONC. | TAIL | FE. | WT. | CONDITIONS | TONS CRUDE | FEED | CONC. | TAIL | FE. | WT. |
| | | | | | | Without Recycling Middlings | | | | | | |
| 65525 | 32.6 | 66.5 | 8.5 | 84.8 | 41.6 | 1st period | 60566 | 32.4 | 66.6 | 9.2 | 83.2 | 40.5 |
| 90021 | 34.0 | 66.2 | 9.1 | 85.0 | 43.6 | 3rd period | 97534 | 33.0 | 66.2 | 9.4 | 83.3 | 41.6 |
| 155546 | 33.4 | 66.3 | 8.8 | 84.9 | 42.8 | Weighted Mean | 158100 | 32.8 | 66.4 | 9.3 | 83.3 | 41.2 |
| | | | | | | Difference | | (−0.6) | (+0.1) | (+0.5) | (−1.6) | (−1.6) |
| | | | | | | Middlings Recycled | | | | | | |
| 58661 | 31.1 | 66.3 | 7.9 | 84.7 | 39.7 | 2nd period | 59131 | 32.0 | 66.1 | 7.1 | 87.2 | 42.1 |
| 94076 | 31.6 | 66.0 | 9.3 | 82.1 | 39.3 | 4th period | 98603 | 31.2 | 66.0 | 8.4 | 83.7 | 39.6 |
| 152737 | 31.4 | 66.1 | 8.8 | 83.0 | 39.4 | Weighted Mean | 157734 | 31.5 | 66.1 | 7.9 | 85.1 | 40.5 |
| | | | | | | Difference | | (+0.1) | (0.0) | (−0.9) | (+2.1) | (+1.1) |

I claim:

1. Method of processing ore comprising (A) grinding and screening said ore to a size containing a significant portion of locked middlings, (B) separating the screened undersize in a rougher spiral to obtain a low-value tailing and a concentrate which includes a major portion of locked middlings, (C) passing the concentrate therefrom including the locked middlings to a cleaner spiral for separation into (i) a cleaner concentrate and (ii) a cleaner tailing, the cleaner tailing comprising (a) a cleaner water fraction and (b) a cleaner sand fraction predominating in locked middlings, (D) recycling the cleaner sand fraction for regrinding, and (E) further processing the cleaner concentrate to obtain a final product.

2. Method of claim 1 wherein the grinding is conducted in an autogenous mill.

3. Method of claim 1 wherein the cleaner concentrate is further processed in a recleaner spiral to obtain a recleaner concentrate and a fraction of middlings, and recycling said middlings to the intake of the rougher spiral.

4. Method of claim 1 wherein the ore is specular hematite.

5. Method of claim 1 wherein the grinding and screening size of step (A) is −3 mm.

6. Method of beneficiating ground ore in a series of spiral concentrators comprising (a) operating a rougher spiral to produce (1) a tailing having an iron content no greater than a predetermined maximum and (2) a concentrate, (b) operating a cleaner spiral to remove locked middlings from the concentrate obtained in the rougher spiral, and (c) operating a recleaner spiral to produce a product of the desired iron content from the concentrate obtained in the cleaner spiral.

7. Method of claim 6 in which the locked middlings are reground and introduced to the rougher spiral feed.

8. Method of claim 6 in which mechanical middlings are recovered in the recleaner spiral and introduced without regrinding to the rougher spiral.

9. The method of claim 7 in which mechanical middlings are recovered in the recleaner spiral and introduced without regrinding to the rougher spiral.

10. Method of claim 7 wherein nothing is discarded from the recleaner spiral.

11. Method of claim 6 wherein the ore has a Taggart Concentration Criteria factor of about 2.0 to about 3.0.

* * * * *